US009341091B2

(12) United States Patent
Hofmann et al.

(10) Patent No.: US 9,341,091 B2
(45) Date of Patent: May 17, 2016

(54) HYDRAULIC VALVE FOR PIVOT MOTOR ADJUSTMENT DEVICE OF A CAMSHAFT

(71) Applicant: Hilite Germany GmbH, Marktheidenfeld (DE)

(72) Inventors: Tanja Hofmann, Erlenbach (DE); Dietmar Schulze, Muenzenberg (DE)

(73) Assignee: Hilite Germany GmbH, Marktheidenfeld (DE)

( * ) Notice: Subject to any disclaimer, the term of this patent is extended or adjusted under 35 U.S.C. 154(b) by 35 days.

(21) Appl. No.: 14/573,214

(22) Filed: Dec. 17, 2014

(65) Prior Publication Data

US 2015/0218977 A1 Aug. 6, 2015

(30) Foreign Application Priority Data

Jan. 31, 2014 (DE) ..... 10 2014 101 236

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/34426* (2013.01); *F01L 2001/34486* (2013.01)

(58) Field of Classification Search
CPC ..... F01L 1/3442; F01L 2001/34426
USPC ..... 123/90.17
See application file for complete search history.

(56) References Cited

U.S. PATENT DOCUMENTS 6,668,778 B1 * 12/2003 Smith ..... F01L 1/022 123/90.15
2013/0206088 A1 8/2013 Wigsten

FOREIGN PATENT DOCUMENTS

| | | | |
|---|---|---|---|
| DE | 10143433 | B4 | 4/2003 |
| DE | 102005055199 | A1 | 5/2007 |
| DE | 102009024026 | A1 | 12/2010 |
| DE | 102010019004 | A1 | 11/2011 |
| DE | 102010061337 | A1 | 6/2012 |
| EP | 1447602 | A1 | 8/2004 |
| EP | 2503201 | B1 | 9/2012 |
| FR | 525481 | | 9/1921 |

* cited by examiner

*Primary Examiner* — Zelalem Eshete
(74) *Attorney, Agent, or Firm* — Von Rohrscheidt Patents

(57) ABSTRACT

A hydraulic valve for a pivot motor adjustment device of a camshaft, the hydraulic valve including a valve housing with a longitudinal axis and a valve piston that is axially moveable in the valve housing along the longitudinal axis, wherein a first operating connection of the valve housing and a second operating connection of the valve housing is openable and closable by the valve piston, wherein the first operating connection and the second operating connection are axially offset from one another; and a supply connection of the valve housing, wherein the supply connection supplies the hydraulic valve with hydraulic fluid fed by a feed device, wherein the hydraulic fluid flows through the hydraulic valve on different paths defined by a flowable channel system of the valve piston.

11 Claims, 6 Drawing Sheets

HYDRAULIC VALVE FOR PIVOT MOTOR ADJUSTMENT DEVICE OF A CAMSHAFT

RELATED APPLICATIONS

This application claims priority from German patent application DE 10 2014 101 236.4 filed on Jan. 31, 2014 which is incorporated in its entirety by this reference.

FIELD OF THE INVENTION

The invention relates to a hydraulic valve for a pivot motor adjustment device of a camshaft according to the preamble of claim 1.

BACKGROUND OF THE INVENTION

Hydraulic valves for pivot motor adjustment devices of a camshafts are well known in the art. Hydraulic valves include a valve piston that is axially moveable in a valve housing of the hydraulic valve. Typically the valve housing includes a first operating connection, a second operating connection and a supply connection. The first operating connection and the second operating connection are connected with the pivot motor adjustment device and a hydraulic fluid is feedable through these connections into the hydraulic valve and also from the hydraulic valve. In order to supply the hydraulic valve with the hydraulic fluid that is fed by a feed device the valve housing includes the supply connection. The hydraulic fluid can flow through the hydraulic valve in different paths controlled by a flowable channel system of the valve piston. In order to use a camshaft adjustment torques the hydraulic valve includes at least one check valve in the portion of the operating connections. Additionally a check valve is arranged in a flow portion of the supply connection. Thus, the check valves facilitate controlling the hydraulic fluid in the hydraulic valve as a function of a pressure.

Check valves for hydraulic valves whose closure elements are configured band shaped are also known. This can be derived from the French patent document FR 525 481 published in 1921 which discloses a check valve including a band shaped closure element.

The patent document DE 101 43 433 B4 discloses a band shaped closure element of a hydraulic valve wherein the closure element includes spring supported closure flaps.

A band shaped closure element of a check valve for a hydraulic valve can also be derived from the patent document EP 2 503 201 B1. The disclosed closure valve is characterized in that it includes a stop at a band end in order to limit its expansion. Since the closure element is only flowable within limits due to the stop different types of flow openings are provided.

The publication document US 2013 206 088 A1 discloses a hydraulic valve whose check valve is provided with a spring based closure element and received in the valve piston.

By the same token check valves with a band shaped closure elements for pivot motor adjustment devices for camshafts are known. The publication documents DE 10 2010 061 337 A1 and DE 10 2010 019 004 A1 disclose hydraulic valves with a band shaped closure element of the check valve. Contrary to the hydraulic valve known from DE 10 2010 061 337 A1 which respectively uses a check valve for the first operating connection and the second operating connection the hydraulic valve disclosed in DE 10 2010 019 004 A1 includes a single check valve through which the first operating connection and the second operating connection can be loaded as a function of a positioning of the valve piston that is axially moveable in the valve housing of the hydraulic valve along a longitudinal axis of the valve housing. The operating connection and the second operating connection are thus axially offset from one another wherein the supply connection of the valve housing is arranged between the first operating connection and the second operating connection. In order to flow the hydraulic valve through ring grooves in the valve housing are associated with the connections.

The check valve is arranged at the valve piston in a positioning groove of the valve piston that is oriented towards the ring grooves wherein the positioning groove is connected with the channel system in a flowable manner wherein the valve piston is moveable in the valve housing. Due to the axial move ability of the valve piston there is an option to use the first check valve for both operating connections.

The hydraulic fluid can flow through the hydraulic valve on different paths determined by the flowable channel system wherein a first tank connection of the hydraulic valve is configured at the valve housing providing a drain for the hydraulic fluid out of the hydraulic valve.

In order to quickly adjust the camshaft a quick and unimpeded response of the hydraulic valve, put differently a quick axial movement of the valve piston in the valve housing is required. Thus, it is necessary that the closure element of the check valve does not contact the valve housing during operations of the pivot motor adjustment device.

BRIEF SUMMARY OF THE INVENTION

Thus, it is an object of the invention to provide a hydraulic valve for a pivot motor adjustment device of a camshaft which hydraulic valve provides improved response.

The object is achieved according to the invention through a hydraulic valve for a pivot motor adjustment device of a camshaft, the hydraulic valve including a valve housing with a longitudinal axis and a valve piston that is axially moveable in the valve housing along the longitudinal axis, wherein a first operating connection of the valve housing and a second operating connection of the valve housing is openable and closable by the valve piston, wherein the first operating connection and the second operating connection are axially offset from one another; and a supply connection of the valve housing, wherein the supply connection supplies the hydraulic valve with hydraulic fluid fed by a feed device, wherein the hydraulic fluid flows through the hydraulic valve on different paths defined by a flowable channel system of the valve piston, wherein a first tank connection of the hydraulic valve is configured at the valve housing and provides an outflow of the hydraulic fluid from the hydraulic valve, wherein a first check valve is positioned at the valve piston in a positioning groove of the valve piston so that the first check valve prevents an outflow of the hydraulic fluid from the positioning groove into the channel system, and wherein the hydraulic valve includes a limitation element at least partially enveloping the first check valve and limiting a radial expansion of the first check valve.

Advantageously embodiments with advantageous and non-trivial variations of the invention are provided in the respective dependent claims.

The hydraulic valve according to the invention for a pivot motor adjustment device of a camshaft includes a limitation element at least partially enveloping the check valve wherein the limitation element limits a radial expansion of the check valve. Through the at least partial envelopment of the check valve, in particular of a closure element of the check valve, the check valve is limited with respect to its radial expansion provided during operations of the hydraulic valve. This leads to improved and faster response of the hydraulic valve since a contact or a touching of the check valve at the valve housing is prevented.

The check valve is opened as a function of a pressure ratio provided at the check valve. Since the closure element of the check valve is band shaped, and the positioning groove is provided over its entire circumference the closure elements expands in radial direction as a function of the pressure ratio. Now put differently the closure element expands at least partially in a direction of the valve housing. The radial expansion is provided as a function of a provided pressure ratio. A high pressure ratio leads to a strong expansion. This means that the closure element can expand at least partially radially out of the positioning groove and that the closure element can contact an inner valve surface oriented towards the positioning groove or that it can touch this valve surface. This contact can lead to a damaging of the valve housing and/or to impeding an axial movement of the valve piston.

The limitation element prevents a respective contacting of the check element at the valve housing since the limitation element is configured so that it envelops the check element at least partially and therefore provides a resistance to the radial expansion of the check element.

In order to effectively limit the check element the limitation element is configured so that it is supported at the valve piston. Thus, the radial arrangement and also the axial arrangement of the limitation element relative to the check element is maintained in each position of the valve piston so that a touching or a contact of the check element or its closure element at the valve housing is safely prevented. Providing the limitation element at the valve housing would lead to a change of an axial arrangement relative to the stop element for an axial movement of the valve piston and the check element could contact the valve housing in a portion that is not enveloped by the limitation element.

Like the check valve the limitation element is arranged in the positioning groove of the valve piston. In order to provide a radial distance between the closure element of the check valve and the limitation element wherein the radial distance is required so that the check valve can open within this radial distance, the limitation element is received at a first shoulder and at a second shoulder of the positioning groove, wherein the shoulders are provided at walls of the positioning groove at a required radial distances from the closure element of the check valve.

In order for the hydraulic fluid to be able to flow in the direction released by the check valve the limitation element includes at least one pass through opening. Ideally pass through openings are arranged distributed over a circumference of the limitation element. These pass through openings have to be configured so that a flow resistance which is provided as a consequence by the limitation element in the flow path of the hydraulic fluid is as small as possible. This means that an effective flow cross section of the limitation element which is provided as a sum of the individual effective flow cross sections of the pass through openings should at least approximately correspond to the effective flow cross section of the positioning groove. This is necessary so that pressure losses or flow losses which can be caused by the limitation element are avoided to the largest possible extent.

In order to provide simple mounting for the limitation element the limitation element is made from a band. The band is introduced bent into the positioning groove so that it envelops the shoulders, thus with a small preload, wherein a first band portion of the band and a second band portion of the band are arranged overlapping in installed condition in order to produce the hollow cylindrical shape of the limitation element.

Advantageously a second tank connection of the hydraulic valve is configured at the valve housing so that a respective tank connection can be associated with the first operating connection and the second operating connection independently from one another.

In another embodiment of the hydraulic valve according to the invention the valve piston includes a throttling element for throttling a fluid drainage of the hydraulic fluid at the valve piston, in particular so that the throttle element envelops the valve piston over its radial circumference. Typically throttle elements are arranged at the valve housing in portions of faces of the valve piston. This arrangement leads to an axial force that impacts the accordingly loaded face of the valve piston. When the throttle element is configured as suggested at the valve piston, in particular at its circumference, the axial force is eliminated so that a position change of the valve piston in the hydraulic valve can be provided very quickly since the valve piston does not have to be moved against an axial force caused by the throttle element.

In a particularly economical embodiment the throttle element has a polygon shaped circumference. This polygon shaped circumference can be implemented in a simple manner e.g. through so called eccentrical turning.

The hydraulic valve is advantageously configured as a central valve so that reduced installation space and improved response are provided compared to an external hydraulic valve since conduction paths for the hydraulic fluid can be kept short.

BRIEF DESCRIPTION OF THE DRAWINGS

Additional features and advantages of the invention can be derived from the subsequent description of advantageous embodiments with reference to appended drawing figures.

The features and feature combinations recited in the description and individual features and feature combinations recited in the description of the drawings and/or in the drawings and feature combinations are not only useable in the respectively provided combination but in also other combinations or by themselves without departing from the spirit and scope of the invention. Identical reference numerals are associated with identical or functionally equivalent elements. In order to provide clarity it may be the case that elements are not provided with numerals in all drawing figures, wherein.

DETAILED DESCRIPTION OF THE INVENTION

Figure 1:
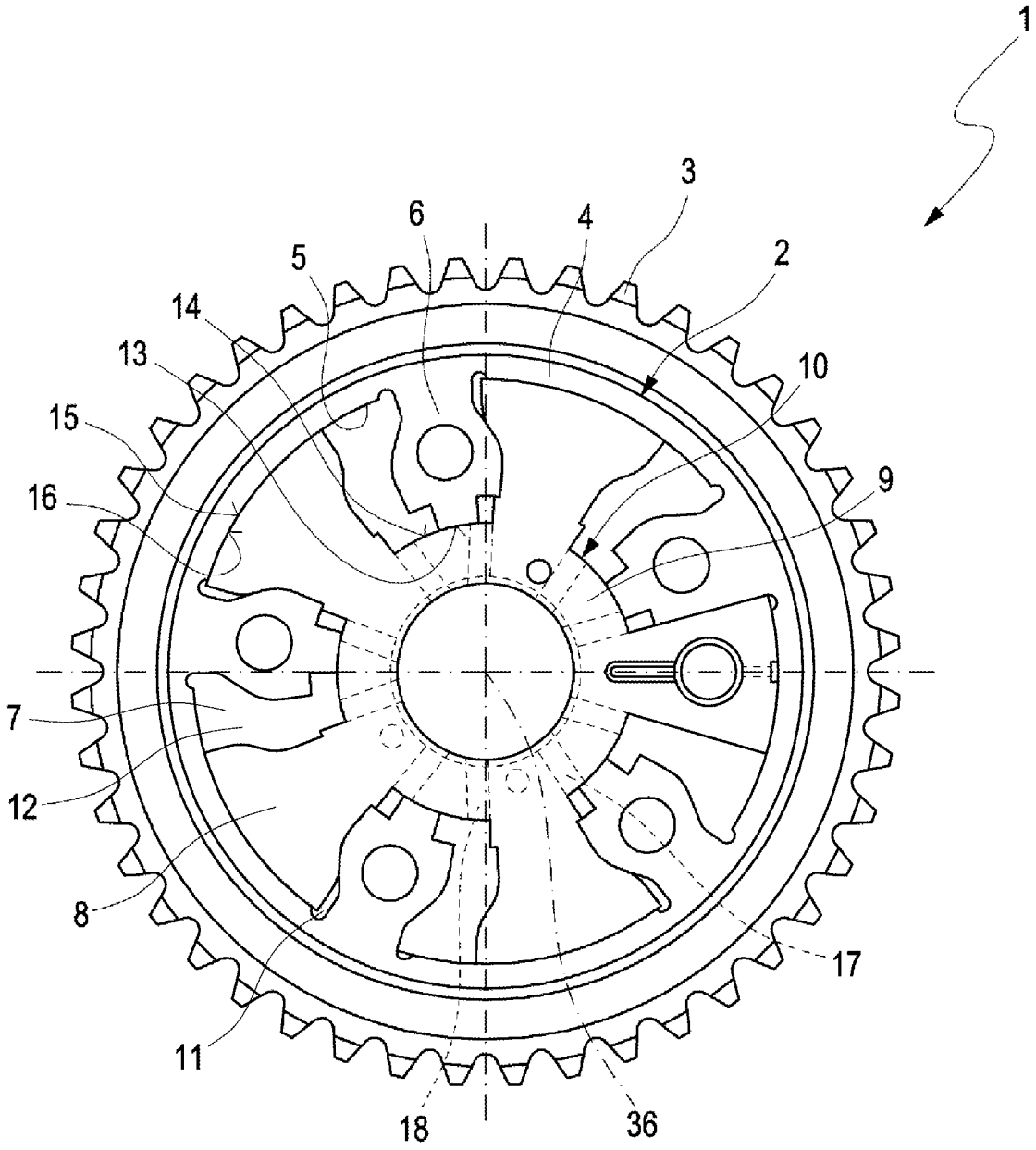
FIG. 1 illustrates a cross section of a pivot motor adjustment device according to the invention.

A pivot motor adjustment device 1 according to FIG. 1 facilitates adjusting opening and closing times of gas flow control valves of the internal combustion engine during operations of the internal combustion engine that is not illustrated in more detail. Thus, a relative angular position of a camshaft that is not illustrated in more detail of the internal combustion engine is adjusted continuously variable by the pivot adjustment motor device 1 relative to a crank shaft that is not illustrated in more detail of the internal combustion engine, wherein the camshaft is rotated relative to the crank shaft. A relative rotation of the crank shaft moves opening and closing times of the gas flow control valves so that the internal combustion engine provides optimum power at a respective speed.

The pivot motor adjustment device 1 includes a cylindrical stator 2 which is connected torque proof with a drive gear 3 of the camshaft. In the illustrated embodiment the drive gear 3 is a sprocket over which a non illustrated chain is run as a drive element. The drive gear 3 can also be a timing belt cog over which a timing belt is run forming a drive element. Through this drive element and the drive gear 3 the stator 2 is drive connected with the crank shaft.

The stator 2 includes a cylindrical stator base element 4 on which radially inward extending bars 6 are configured at even distances on an inside 5 wherein an intermediary cavity 7 is formed between two respectively adjacent bars 6. A pressure medium, typically hydraulic fluid, is introduced in a controlled manner into this intermediary cavity 7, through a hydraulic valve 20 that is illustrated in more detail in FIG. 2.

A lobe 8 is positioned so that it protrudes into the intermediary cavity 7, wherein the lobe is arranged at a rotor hub 9 of the rotor 10. Corresponding to the number of intermediary cavities 7 the rotor hub 9 includes a number of lobes 8.

Through the lobes 8 the intermediary cavities 7 are respectively divided into a first pressure cavity 11 and a second pressure cavity 12. In order to reduce a pressure loss in the first pressure cavity 11 and the second pressure cavity 12, the bars 6 are configured so that they contact an outer enveloping surface 14 of the rotor hub 9 with their first faces 13 providing a seal through the contact. By the same token the lobes 8 contact an inner wall 16 of the stator base element 4 with their second faces 15 wherein the inner wall 16 is positioned opposite to the outer enveloping surface 14 and a seal is provided through the contact.

The rotor 10 is connected torque proof with the camshaft of the internal combustion engine. In order to adjust an angular position between the camshaft and the crank shaft the rotor 10 is rotated relative to the stator 2. For this purpose the pressure medium in the first pressure cavity or in the second pressure cavity 12 is pressurized as a function of a selected direction of rotation, whereas the second pressure cavity 12 or the first pressure cavity 11 is unloaded. The unloading is provided through a tank access which is opened for unloading. This can be a single tank access that is accessible to the first pressure cavity 11 and the second pressure cavity 12 or as illustrated in the embodiment according to FIG. 2 a first tank inlet T1 is associated with the first pressure cavity 11 and a second tank access T2 is associated with the second pressure cavity 12.

In order to rotate the rotor 10 clock wise relative to the stator, radial first hub bore holes 17 are pressurized by the hydraulic valve 20 wherein the hub bore holes 17 are evenly distributed over a circumference of the rotor hub 9. In order to rotate the rotor 10 relative to the stator 10 counter clockwise radially oriented second hub bore holes 18 are pressurized through the hydraulic valve 20 wherein the radially oriented second bore holes are also arranged distributed over the circumference of the rotor hub 9, wherein the second hub bore holes 18 are positioned axially offset from the first hub bore holes 17.

Figure 2:
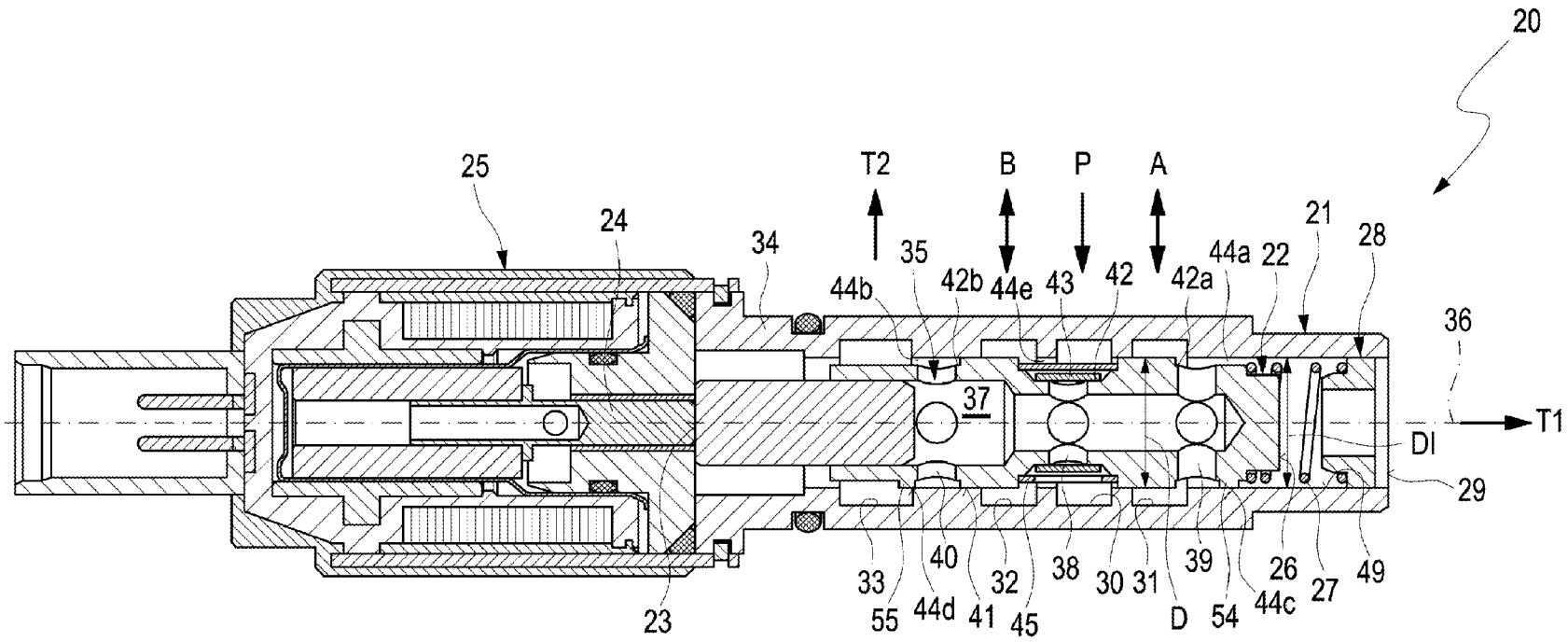
FIG. 2 illustrates a longitudinal sectional view of a hydraulic valve according to the invention.

In FIG. 2 the hydraulic valve 20 according to the invention is illustrated in a longitudinal sectional view in a first valve position. The hydraulic valve 20 is configured similar to a cartridge valve and includes a valve housing 21 in which a valve piston is arranged axially moveable.

In order to move the valve piston 22 a first face 23 of the valve piston 22 that is oriented away from the internal combustion engine is closed so that a plunger 24 of an electromagnetic linear actuator 25 can contact this first face 23. Providing power to the linear actuator 25 causes an axial movement of the valve piston 22 towards the internal combustion engine wherein a retaining element arranged at a second face 26 of the valve piston 22, wherein second face 26 if oriented away from the first face 23, imparts a retaining force onto the valve piston 22 against which retaining force the valve piston 22 has to be moved. The retaining element 27, in this embodiment configured as a compression coil spring, is supported at a hollow cylinder 28 which is arranged with a press fit in the valve housing 21 in a portion of a housing face 29 that is oriented towards the internal combustion engine.

The sleeve shaped valve housing 21 includes a supply connection P, a first operating connection A and a second operating connection B. A first ring groove 30 is associated with the supply connection P a second ring groove 31 is associated with the first operating connection A and a third ring groove 32 is associated with the second operating connection B, wherein the respective ring grooves are connected with the connections through respective linking channels. The linking channels are configured so that they completely penetrate a housing wall 34 of the valve housing 21.

The supply connection P is configured to connect with an oil pump that is not illustrated in mover detail, so that the hydraulic valve 20 is supplyable with the hydraulic fluid which is oil in this embodiment. The first operating connection A is connectable with the first hub bore holes 17, the second operating connection B is connectable with the second hub bore holes 18. The first tank access T1 is arranged at the housing face wall 29. The second tank access T2 is connectable with a fourth ring groove 33 of the valve housing 21 which ring groove is axially offset from the supply connection B, wherein the connection can be provided through an additional linking channel that is not illustrated in more detail and which leads into the fourth ring groove 33. The fourth ring groove 33 is arranged between the first face 23 and the third ring groove 32.

The valve piston 22 is configured so that it can be flowed through and it includes a channel system 35 which can be flowed through by the hydraulic fluid. A supply channel 37 of the channel system 35 is provided along a longitudinal axis 36 of the valve piston 22, wherein a first channel group 38, a second channel group 39 and a third channel group 40 traverse the supply channel 37 respectively axially offset from one another. The first channel group 38, the second channel group 39 and the third channel group 40 are flow connected with one another through the supply channel 37, so that hydraulic fluid for example from the first channel group 38 can flow through the supply channel 37 into the second channel group 39 and/or the third channel group 40. A channel group in this embodiment respectively includes two transversal bore holes that intersect each other and that are positioned perpendicular relative to one another, wherein the transversal bore holes are configured so that they extend over a diameter D of the valve piston 22 so that they penetrate the valve piston 22 in its entirety. By the same token the channel group could also include a different number of transversal bore holes.

At ends of a first channel group 38 which ends are oriented towards an enveloping surface 41 of the valve piston 22, of the second channel group 39 and of the third channel group 40 the valve piston 22 respectively includes an annular groove, this means a positioning groove 42, a fifth ring groove 42*a*, and a sixth ring groove 42*b* wherein the ends of the first channel group 38 lead into the positioning groove 42, the ends of the second channel group 39 lead into the fifth ring groove 42*a* and the ends of the third channel group 40 lead into the sixth ring groove 42*b*. In the positioning groove 42 a first check valve 43 is received, whose closure element is configured band shaped. A check valve with a band shaped closure element is known and can be derived e.g. EP 1 703 184 B1. It is appreciated that a check valve per definition includes a housing and a closure element opening or closing the flow through opening of the housing. In case of a band shaped closure element walls that define the flow through opening can be used to form the housing for the band shaped closure element as illustrated in the embodiment. Therefore the first check valve 43 is subsequently interpreted as the closure element and vice versa.

The first closure element 43 prevents an inflow of the hydraulic fluid from the first ring groove 30, from the second ring groove 31 and from the third ring groove 32 into the first channel group 38. On the other hand side the first check valve 43 opens when hydraulic flows through the first channel group 38 from the supply channel 37. Put differently, the first check valve 43 closes in a direction towards the supply channel 37 and opens in a direction towards the ring grooves 30, 31, 32.

A second check valve 4 is provided outside of the valve housing 21 between the supply connection P and the oil pump in order to prevent a back flow of the hydraulic fluid into the oil pump.

Figure 3:
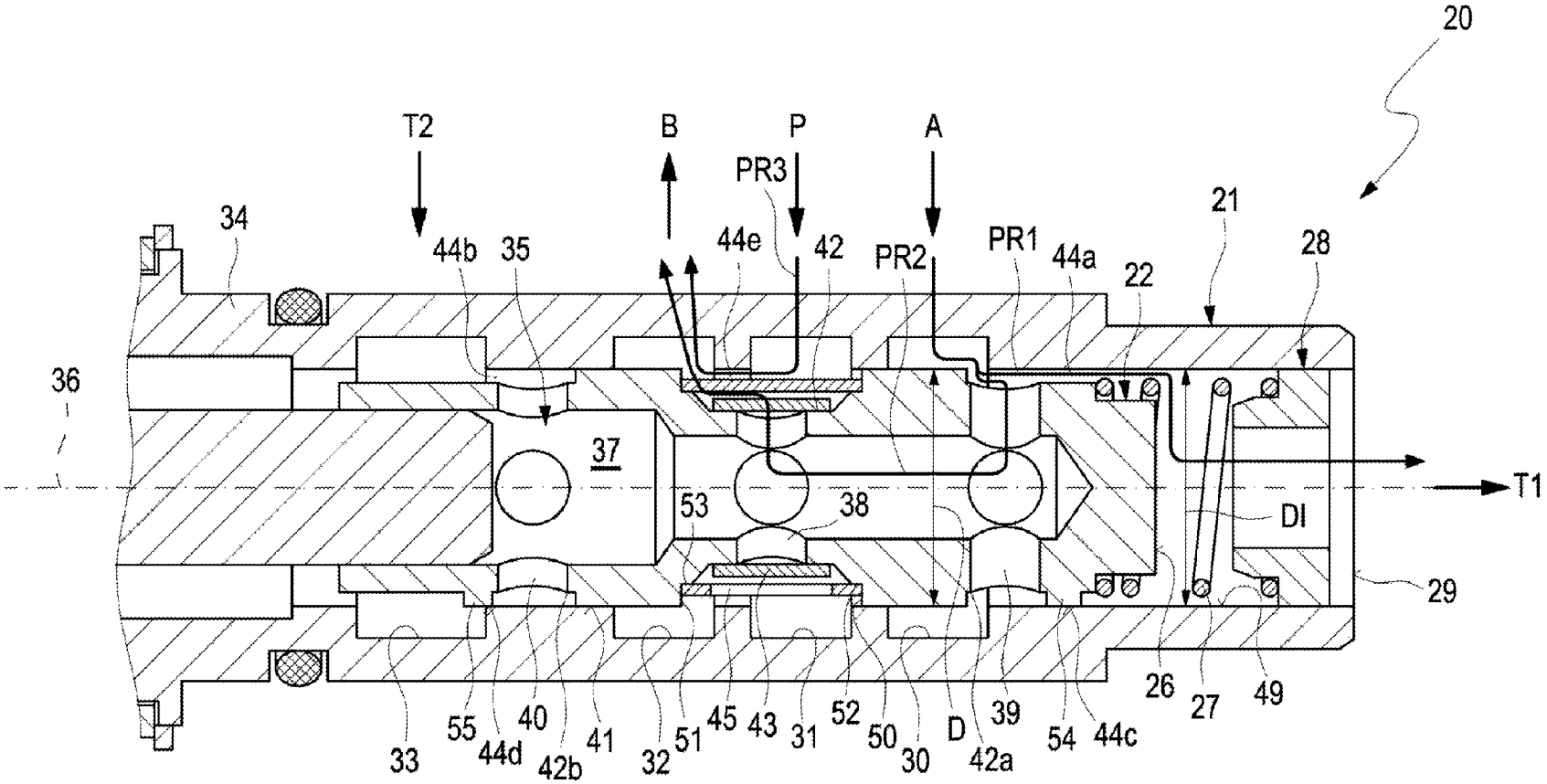
FIG. 3 illustrates a detail of a longitudinal sectional view of the hydraulic valve according to FIG. 2.

The first valve position of the hydraulic valve 20 illustrated in FIG. 2 corresponds to a valve position in an unpowered condition of the linear actuator 25. In this condition the fifth ring groove 42*a* at least partially covers the second ring groove 31, so that the hydraulic fluid from the first pressure cavities 11 can flow through the first hub bore holes 17, the first operating connection A and the second ring groove 31 into the fifth ring groove 42*a* and further into the second channel group 39, provided a first pressure in the first pressure cavities 11 exceeds a second pressure that is provided in the channel system 35. The hydraulic fluid flowing out of the second ring groove 31 is separated into a first fluid flow and second fluid flow while providing pressure compensation. The first fluid flow can flow out of the second ring groove 31 due to the partial overlap of the fifth ring groove 42*a* and the second ring groove 31 through a first gap 44*a* into the first tank access T1 according to the arrow direction PR1, c.f. FIG. 3, wherein the first gap 44*a* is configured in the portion between the second face 26 and the fifth ring groove 42*a* between the enveloping surface 41 and a valve inner surface 49 of the valve housing 21. The gap 44*a* is configured in sections over the circumference of the valve piston 22.

The second fluid flow flows according to the second arrow direction PR2 into the second channel group 39 and from there into the supply channel 37 wherein the fluid flow moves into the third ring groove 32 through the first check valve 43. The third ring groove 32 is covered in this valve position at least partially by the positioning groove 42, so that the inflow of the hydraulic fluid from the first channel group 38 can be provided through the positioning groove 42 into the third ring groove 32. The hydraulic fluid flowing out of the supply connection P onto the first check element 43 flows through a third gap 44*e* which is configured in the first valve position between the positioning groove 42 and the inner valve surface 49 according to the third arrow direction PR3 into the third ring groove 32.

The hydraulic fluid thus moves through the second operating connection B into the second hub bore holes 18 which are connected with the second pressure cavities 12, so that the pressure in the second pressure cavities increases and the drive wheel 3 is rotated counter clock wise relative to the stator 2.

As soon as the camshaft due to its switching torques tends to rotate into the intended adjustment direction, the pressure in the first pressure cavities 11 increases. When this pressure is large enough so that the preloaded first check valve opens sufficient hydraulic fluid is provided through the second operating connection B to the second pressure cavities 12 which have a suction effect due to a vacuum so that a rotation of the rotor 10 is provided. A fast rotation is provided that could not be provided by the oil pump alone.

A second valve position can be adjusted by providing power to the linear actuator 25. The valve piston 22 is pushed into its end position against a force of the retaining element 27 in a direction towards the first tank access T1. In this end position the second face 26 contacts the hollow cylinder 28. Thus the valve piston 22 was axially moved far enough so that the overlap of the fifth ring groove 42*a* and the second ring groove 31 is removed so that the second ring groove 31 is closed by the enveloping surface 41.

Due to the axial movement of the valve piston 22, an overlap is provided between the positioning groove 42 and the second ring groove 31 and the first ring groove 30 so that an overflow of the hydraulic fluid is provided from the supply connection P into the first operating connection A. Furthermore at least a partial overlap of the sixth ring groove 42*b* and the third ring groove 32 is provided. The hydraulic fluid which now flows from the second operating connection B separates into a third fluid flow and a fourth fluid flow, wherein the third fluid flow can enter the first channel groove 38 through the third channel group 40 and the supply channel 37.

After opening the first check valve 43 the third fluid flow continues to flow from the positioning groove 42 into the second ring groove 31. The fourth fluid flow flows through a second gap 44*b* that is configured between the valve inner surface 49 and the enveloping surface 41 into the second tank connection T2.

This context and the basic principle of the hydraulic valve 20 are also described in more detail in DE 10 2010 019 004 A1 so that they are not described herein in more detail.

Figure 4:
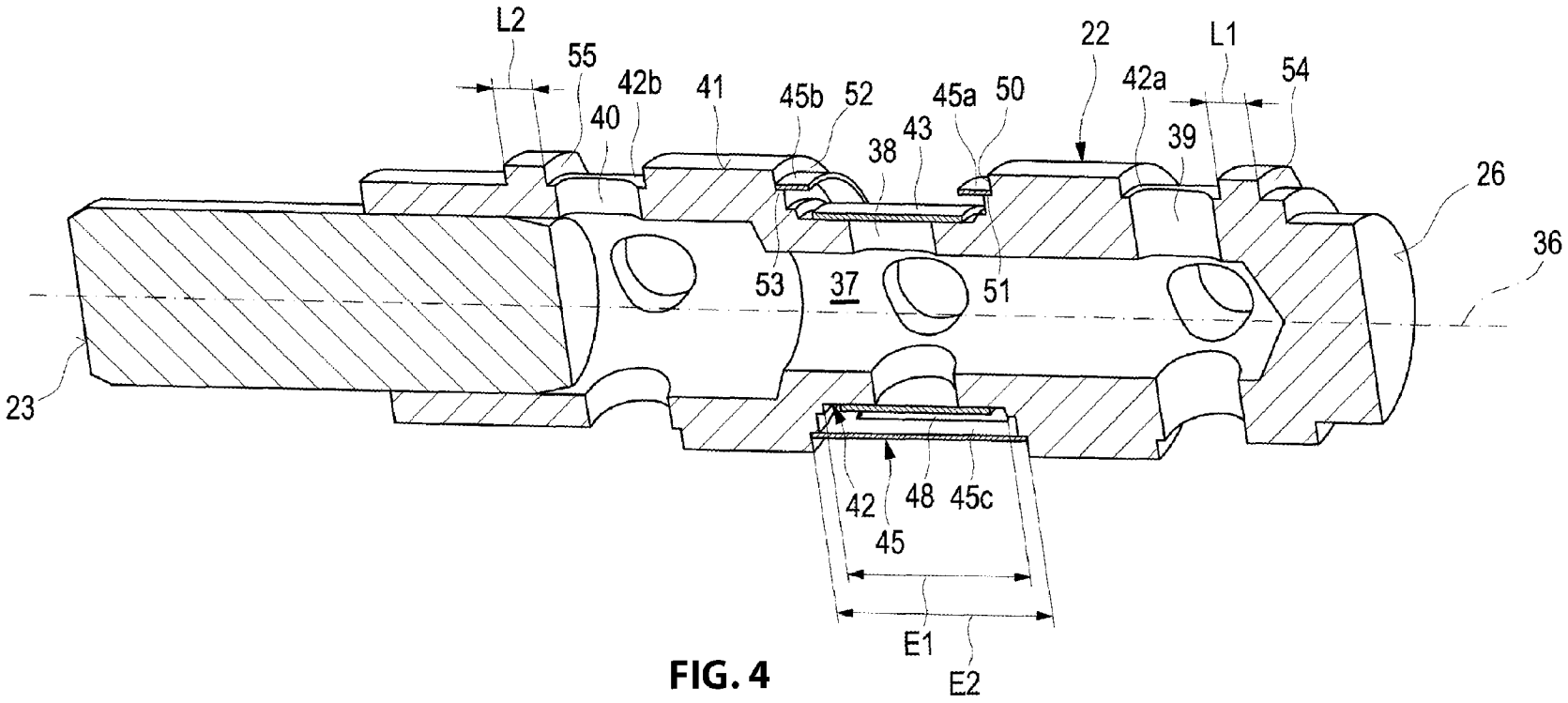
FIG. 4 illustrates a three dimensional sectional view of a valve piston of the hydraulic valve according to FIG. 2.

FIG. 4 illustrates the valve piston 22 in a longitudinal sectional view along the longitudinal axis 36 in three dimensions. The positioning groove 42 is configured in steps so that in its radial extension a first shoulder 51 is configured at a first wall 50 that is oriented towards its first face 26 and a second shoulder 53 is configured at its second wall 52 that is arranged opposite to its first wall 50, so that the positioning groove 42 has a first axial extension E1 and a second axial extension E2, wherein the first axial extension E1 is configured smaller than the second axial extension E2.

The first check valve 43 is received in the portion of the positioning groove 42 which has the first extension E1, wherein the first wall 50 and the second wall 52 are used for axially securing the check valve 43. Axial end portions of the band shaped closure element of the check valve 43 overlap each other slightly so that an opening pressure can be kept small.

Figure 5:
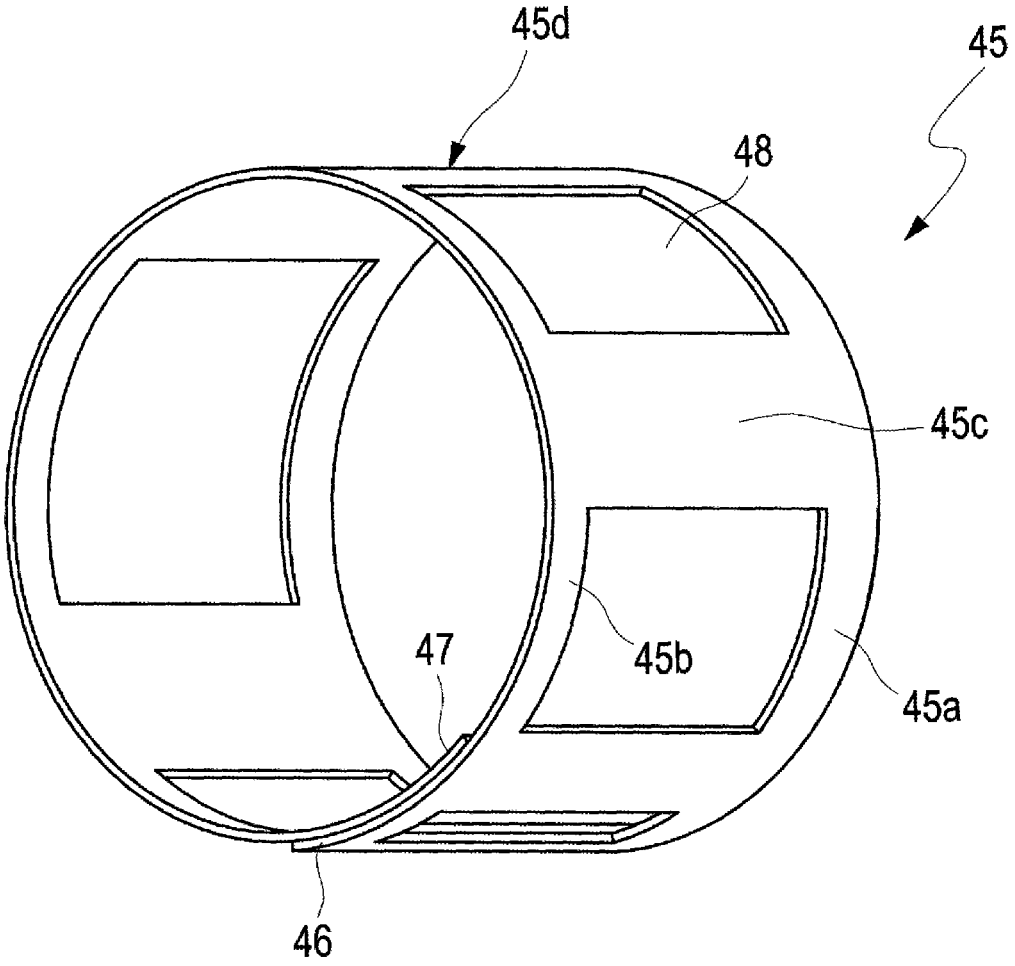
FIG. 5 illustrates a perspective view of a cage of the hydraulic valve according to FIG. 2.

In order to limit a radial expansion of the check valve 43 or the closure element of the check valve 43 an annular limitation element 45 which envelops the check valve 43 is arranged at the valve piston 22. The limitation element 45 is illustrated in more detail in a perspective view in FIG. 5. The limitation element 45 is made from a band 45*d* which includes transversal struts 45*c* of the band 45*d* between a first longitudinal strut 45*a* of the band 45*d* and a second longitudinal strut 45*b* of the band 45*d*, wherein the transversal struts 45*c*, the first longitudinal strut 45*a* and the second longitudinal strut 45*b* are configured so that they connect with each other.

In order to position the limitation element 45 at the valve piston 22 and thus to envelop the first check valve 43 the band shaped limitation element 45 is bent so that a first band portion 46 and a second band portion 47 overlap one another and the band 45*d* contacts the valve piston 22 like a ring.

Between the transversal struts 45*c* and the longitudinal struts 45*a*, 45*b* pass through openings 48 of the limitation element 45 are configured rectangular for a free pass through of the hydraulic fluid in this embodiment.

The limitation element 45 can be also made from a band shaped perforated sheet material, to that the limitation element 45 that is provided with numerous pass through openings 48 is configured similar to a sieve. Additional modifications of the limitation element are conceivable, wherein the pass through openings 48 have to be configured so that a pressure loss which can be provided by the limitation element 45 in the flow path of the hydraulic fluid from the first channel group 38 into the positioning groove 44 is kept as small as possible or so that it is eliminated.

The limitation element 45 is arranged at the valve piston 22 so that it is supported at the first shoulder 51 and at the second shoulder 52 by the first longitudinal strut 45*a* or the second longitudinal strut 45. Put differently the first longitudinal strut 45*a* and the second longitudinal strut 45*b* contact over their axial extension at least partially at the first shoulder 51 or the second shoulder 52 wherein the pass through openings 48 form a free flow cross section for the hydraulic fluid. A radial extension of the first check valve 43 is limited by the transversal struts 45*c*, so that a contact of the first check valve 43 or the closure element of the check valve 43 with the inner valve surface is prevented.

An implementation of throttling the flow of the hydraulic fluid into the first tank access T1 without axial force and into the second tank access T2 is provided with a first throttle element 54 or a second throttle element 55. The first throttle element 54 is provided between the fifth ring groove 42*a* and the second face 26 adjacent to the fifth ring groove 42*a* and the second throttle element 45 is provided between the sixth ring groove 42*b* and the first face 23 adjacent to the sixth ring groove 42*b*. These throttle elements 54, 55 completely envelop the radial circumference of the radial valve piston 22.

Figure 6:
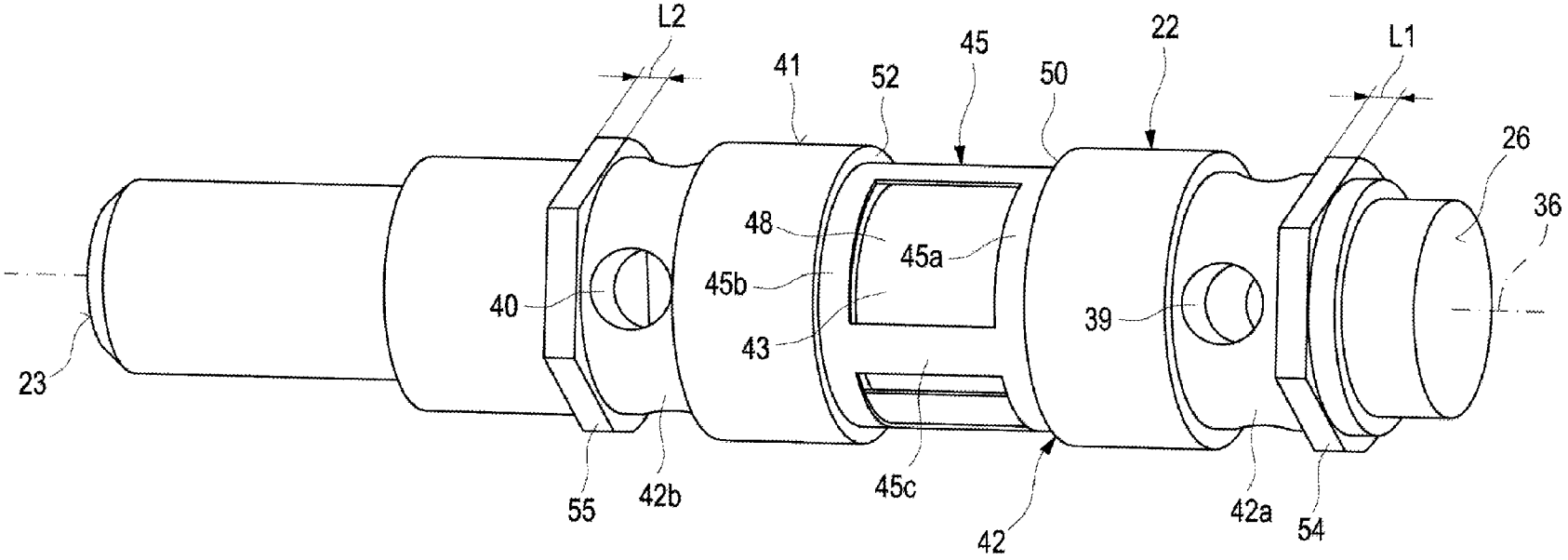
FIG. 6 illustrates a perspective of the valve piston according to FIG. 4.

The first throttle element 54 and the second throttle element 55 include a polygon shaped radial circumference c.f. in particular FIG. 6 so that over the radial circumference of the valve inner surface 49 alternatively the first gap 44*a* and a first seal surface 44*c* or the second gap 44*b* and the second seal surface 44*d* are configured by the first throttle element 54 or the second throttle element 55.

The first throttle element 54 extends adjacent to the fifth ring groove 42*a* over an axial first length L1 and the second throttle element 22*b* extends adjacent to the sixth ring groove 42*b* over an axial second length L2. In this embodiment the first length L1 corresponds to the second length L2. By the same token the first length L1 can deviate from the second length L2. The first length L1 and the second length L2 correspond to a desired throttle effect.

The polygon shaped radial circumference has the shape of a pentagon. It could also have the shape of another polygon wherein due to reducing the pressure loss the polygon shaped radial circumference of the first throttle element 54 and of the second throttle element 55 should not have less than 5 polygon edges. By the same token the number of the polygon edges should not exceed a certain number that is a function of the diameter D of the valve piston 22. This would mean too little differentiation between the circular radial circumference of the valve piston 22 so that an outflow of the hydraulic fluid through the first tank connection T1 and the second tank connection T2 would be throttled too much. As illustrated in particular in FIGS. 2 and 3 the first gap 44*a* is provided by the first polygon shaped throttle element 54. This first gap 44*a* does not extend over the entire radial circumference of the valve piston 22 but the first throttle element 54 partially contacts the valve inner surface 49, thus the first gap 44*a* is only formed in sections.

In the portion of the sixth ring groove 42*b* a second gap 44*b* is implemented through the polygon shaped radial circumference of the second throttle element 55 so that the hydraulic fluid can Flow in a throttled manner from the third channel group 40 over the second gap 44*b* into the second tank access T2.

REFERENCE NUMERALS AND DESIGNATIONS

1 pivot motor adjustment device
2 stator
3 drive gear
4 stator base element
5 inner side
6 bar
7 intermediary cavity
8 lobe
9 rotor hub
10 rotor
11 first pressure cavity
12 second pressure cavity
13 first face
14 outer enveloping surface
15 second face
16 inner wall
17 first hub bore hole
18 second hub bore hole
20 hydraulic valve
21 valve housing
22 valve piston
23 first face
24 plunger
25 linear actuator
26 second face
27 retaining connection
28 hollow cylinder
29 housing face wall
30 first ring groove
31 second ring groove
32 third ring groove
33 ring groove
34 housing wall
35 channel system
36 longitudinal axis
37 supply channel
38 first channel group
39 second channel group
40 third channel group
41 enveloping surface
42 positioning groove
42*a* fifth ring groove
42*b* sixth ring groove
43 first check valve
44*a* first gap

44*b* second gap
44*c* first seal surface
44*d* second seal surface
44*e* third gap
45 limitation element
45*a* first longitudinal strut
45*b* second longitudinal strut
45*c* transversal strut
45*d* band
46 first band portion
47 second band portion
48 pass through opening
49 inner valve surface
50 first wall
51 first shoulder
52 second wall
53 second shoulder
54 first throttle element
55 second throttle element
A first operating connection
B second operating connection
D diameter
DI inner diameter
E1 first axial extension
E2 second axial extension
L1 first length
L2 second length
P supply connection
PR1 first arrow direction
PR2 second arrow direction
PR3 third arrow direction
T1 first tank access
T2 second tank access

What is claimed is:

1. A hydraulic valve for a pivot motor adjustment device of a camshaft, the hydraulic valve comprising:

a valve housing with a longitudinal axis and a valve piston that is axially moveable in the valve housing along the longitudinal axis, wherein a first operating connection of the valve housing and a second operating connection of the valve housing is openable and closable by the valve piston, wherein the first operating connection and the second operating connection are axially offset from one another;

and a supply connection of the valve housing, wherein the supply connection supplies the hydraulic valve with hydraulic fluid fed by a feed device, wherein the hydraulic fluid flows through the hydraulic valve on different paths defined by a flowable channel system of the valve piston, wherein a first tank connection of the hydraulic valve is configured at the valve housing and provides an outflow of the hydraulic fluid from the hydraulic valve, wherein a first check valve is positioned at the valve piston in a positioning groove of the valve piston so that the first check valve prevents an outflow of the hydraulic fluid from the positioning groove into the channel system, and wherein the hydraulic valve includes a limitation element at least partially enveloping the first check valve and limiting a radial expansion of the first check valve.

2. The hydraulic valve according to claim 1, wherein the limitation element is supported at the valve piston.

3. The hydraulic valve according to claim 1, wherein the valve piston includes a shoulder for positioning the limitation element.

4. The hydraulic valve according to claim 1, wherein the limitation element is configured hollow cylindrical and includes at least one pass through opening that is arranged at its circumference.

5. The hydraulic valve according to claim 1, wherein the limitation element is configured as a curved band.

6. The hydraulic valve according to claim 1, wherein a first band portion of the band and a second band portion of the limitation element are arranged overlapping in an installed condition.

7. The hydraulic valve according to claim 1, wherein a second tank connection of the hydraulic valve is configured at the valve housing.

8. The hydraulic valve according to claim 1, wherein the valve piston includes a throttle element throttling a fluid outflow of the hydraulic fluid.

9. The hydraulic valve according to claim 8, wherein the throttle element provides a gap for a fluid outflow of the hydraulic fluid in sections between an inner valve surface of the valve housing and an enveloping surface of the valve piston.

10. The hydraulic valve according to claim 8, wherein the throttle element has a polygon shaped radial circumference.

11. The hydraulic valve according to claim 1, wherein the hydraulic valve is configured as a central valve of a pivot motor adjustment device.

* * * * *